US005592979A

United States Patent [19]

Payne et al.

[11] Patent Number: 5,592,979

[45] Date of Patent: *Jan. 14, 1997

[54] VAPOR RECOVERY SYSTEM FOR A FUEL DELIVERY SYSTEM

[75] Inventors: Edward A. Payne, Greensboro; Hal C. Hartsell, Jr., Kernersville, both of N.C.

[73] Assignee: Gilbarco Inc., Greensboro, N.C.

[ * ] Notice: The term of this patent shall not extend beyond the expiration date of Pat. No. 5,355,915.

[21] Appl. No.: 576,256

[22] Filed: Dec. 21, 1995

Related U.S. Application Data

[62] Division of Ser. No. 294,108, Aug. 22, 1994, Pat. No. 5,542,458.

[51] Int. Cl.[6] ..... B67D 5/08

[52] U.S. Cl. ..... 141/59; 141/7; 141/94; 141/192

[58] Field of Search ..... 141/1, 7, 44, 45, 141/59, 83, 192, 290, 94; 364/465, 500

[56] References Cited

U.S. PATENT DOCUMENTS

| | | | |
|---|---|---|---|
| 4,231,091 | 10/1980 | Motz | 364/431 |
| 4,260,000 | 4/1981 | McGahey et al. | 141/59 |
| 4,396,977 | 8/1983 | Slater et al. | 364/188 |
| 4,534,059 | 8/1985 | Yamada | 382/54 |
| 4,856,317 | 8/1989 | Pidorenko et al. | 364/571.04 |
| 4,873,655 | 10/1989 | Kondraske | 364/553 |
| 4,969,365 | 11/1990 | StrigÅrd et al. | 73/861.77 |
| 4,987,933 | 7/1991 | Mack | 141/7 |
| 5,016,187 | 5/1991 | Forkert et al. | 364/510 |
| 5,038,838 | 8/1991 | Bergamimi et al. | 141/59 |
| 5,040,577 | 8/1991 | Pope | 141/59 |
| 5,121,677 | 11/1992 | Le Claire et al. | 141/280 |
| 5,131,011 | 7/1992 | Bergmans et al. . | |
| 5,156,199 | 10/1992 | Hartsell, Jr. | 141/83 |
| 5,225,995 | 7/1993 | Fujiwara et al. | 364/510 |
| 5,280,814 | 11/1994 | Stroh | 141/83 |
| 5,332,011 | 7/1994 | Spalding | 141/59 |
| 5,345,979 | 9/1994 | Tucker et al. | 141/83 |
| 5,355,915 | 10/1994 | Payne | 141/83 |
| 5,447,062 | 9/1995 | Köpl et al. | 73/261 |
| 5,455,781 | 10/1995 | Reynal et al. | 364/579 |

FOREIGN PATENT DOCUMENTS

| | | | |
|---|---|---|---|
| 8717378 U | 9/1988 | Germany . | |
| 1253283 | 11/1971 | United Kingdom | 222/64 |

*Primary Examiner*—J. Casimer Jacyna
*Attorney, Agent, or Firm*—Rhodes Coats & Bennett, L.L.P.

[57] ABSTRACT

A vapor recovery system used with a fuel dispenser and having capabilities incorporated therein for controlling the rate at which vapor is recovered. The vapor recovery system includes a fuel delivery line connected to a fuel nozzle, a vapor return line connected to the fuel nozzle, a vapor pump in the vapor return line, and a processor connected to the vapor pump. The processor controls the speed of the vapor pump and the vapor recovery rate by generating and directing vapor pump control signals to the vapor pump. The vapor pump control signals are generated by solving a vapor control function stored in a memory operatively connected to the processor. The vapor control function includes a dependent sub-function dependent on independent variables that affect the rate of vapor volume generated during a fueling operation. To solve the control function, the processor accesses solutions to the dependent sub-function via a look-up table containing pre-computed dependent values.

6 Claims, 4 Drawing Sheets

VAPOR RECOVERY SYSTEM FOR A FUEL DELIVERY SYSTEM

This application is a division of application Ser. No. 08/294,108, filed Aug. 22, 1994, now U.S. Pat. No. 5,542,458.

BACKGROUND OF THE INVENTION

As gasoline or other fuel is pumped into an automobile or other motor vehicle from a fuel delivery system, fuel vapor is released from the receiving tank. These vapors must be collected to prevent their escape and pollution of the surrounding environment. Vapor recovery systems are currently used to collect vapors released during a fueling operation. A current product of Gilbarco, Inc., assignee of the present invention, sold under the name VaporVac® collects vapor released during a fueling operation by using a vapor pump to pump vapors into the vapor recovery system. The rate at which vapor is collected is controlled by varying the speed of the vapor pump. For maximum performance and efficiency of a vapor recovery system, the speed of the vapor pump must be controlled to collect vapor at a rate that corresponds to the instantaneous vapor volume released or generated during a fueling operation while drawing in litte or no air.

As is pointed out in U.S. Pat. No. 5,040,577 to Pope, U.S. Pat. No. 5,156,199 to Hartsell et al. and co-pending U.S. application Ser. No. 07/988,595 filed Oct. 29, 1992, the rate at which the vapor must be recovered is determined by several variables including the liquid fuel flow rate, the liquid fuel temperature, the ambient temperature and the amount of fuel dispensed in the current fueling operation.

To operate the vapor pump at an optimal speed, the vapor volume generated is continuously determined by a processor during a fueling operation. The processor computes the instantaneous vapor volume generated and produces corresponding vapor pump control signals that the sent to the vapor pump. The control signals adjust the speed of the vapor pump so that the rate of vapor recovery corresponds to the computed vapor volume generated.

The processor generates the control signal to be sent to the vapor pump by solving a control function. In known vapor recovery systems, the solution to the control function is a value related to the ratio of the instantaneous volume of vapor generated divided by the instantaneous volume of liquid fuel (V/L) dispensed during a fueling operation. The vapor recovery system uses the derived V/L ratio to generate the control signal for controlling the speed of the vapor pump such that the rate at which released fuel vapor is collected is as close as possible to the rate at which vapor is generated during a fueling operation.

As mentioned, the control function used to generate the vapor pump control signal is dependent on a plurality of independent variables which each affect the instantaneous volume of fuel vapor generated during a fueling operation. The independent variables of the control function include flow rate, volume dispensed, time, ambient temperature, fuel temperature, and restrictions in the vapor path. The control function is solved by measuring the independent variables and inputting the measured values into the control function.

To precisely determine the optimal vapor pump speed, a complex control function that models or approximates the thermodynamic, fluid, gas, and other physical laws which ultimately govern the V/L ratio must be solved. Such a complex control function takes into account a plurality of independent variables and requires intensive numerical operations. Implementation of a vapor recovery system that relies on a complex control function to determine optimal vapor pump speed would require a moderate or high-speed processor. Examples of control functions of this sort are shown in the Hartsell et al. patent, supra and in U.S. Pat. No. 5,038,838 to Bergamini et al.

A moderate or high speed processor is required because the processor must be sufficiently proficient to determine the solution to the control function in a time period that does not unduly degrade the accuracy of the system. If an extended period of time is required, the phase margin of the system will be substantially degraded. That is, by the time the control function is computed by a slow processor, the computed value may no longer be accurate.

Commercially available vapor recovery systems, such as the VaporVac® system sold by Gilbarco, Inc. of Greensboro, N.C., have a simplified control function to determine optimal vapor pump speeds. The simplified control function includes two simple sub-functions to approximate the V/L ratio. As another way to simplify the control function, U.S. Pat. No. 5,195,564 to Spalding uses a constant V/L ratio of 1.3:1.

Because a simplified control function is used, a relatively simplified processor and software can be used to solve the control function in a sufficiently short time period. But, vapor recovery systems that rely on simplified control functions are less accurate at recovering vapor. They may provide insufficient suction, letting the vapor escape to the atmosphere, or too much suction, unduly pressurizing underground pipes and tanks.

A vapor recovery system is needed that is capable of accurately controlling the rate of vapor recovery without the need of a moderate to high speed processor.

SUMMARY OF THE INVENTION

The present invention provides an improved system and method for recovering fuel vapor released from a fuel nozzle and/or receiving tank during a fueling operation. In particular, the present invention has the capability of recovering vapor at a controlled rate that corresponds to the instantaneous volume of vapor released during a fueling operation. In addition, the system reduces the processing time required for determining the optimal vapor recovery rate.

In one embodiment of the present invention, the vapor recovery system includes a fuel delivery line connected to a fuel nozzle, a vapor return line connected to the fuel nozzle, a vapor pump in the vapor return line, and a processor connected to the vapor pump. The processor controls the speed of the vapor pump and the vapor recovery rate by generating and directing vapor pump control signals to the vapor pump.

The vapor pump control signals are generated by solving a control function stored in a memory operatively connected to the processor. The control function includes a dependent sub-function dependent on independent variables that affect the rate of vapor volume generated during a fueling operation. To solve the control function, the processor accesses a pre-computed solution to at least one of the dependent sub-functions that is contained in a look-up table indexed by a range of values for the independent variable. The processor can then easily and quickly derive the control function from the values in the look-up table.

The invention may also be provided as a fuel delivery and vapor recovery system that includes a fuel delivery line for dispensing fuel; a fuel pump for pumping fuel through the fuel line to a fuel nozzle; a vapor return line from the nozzle including a vapor recovery pumping arrangement for pumping vapor released at the fuel nozzle as fuel is being pumped; and a processor connected to the vapor recovery pumping arrangement, wherein the rate of vapor recovery is adjusted in response to vapor recovery control signals sent from the processor to the vapor pumping arrangement. A memory device stores a vapor control function for use by the processor for generating the vapor recovery control signals, the vapor control function having a dependent sub-function dependent on an independent variable. A look-up table operatively associated with the processor is composed of solutions to the dependent sub-function for a range of values for the independent variable. A transducer measures the independent variable and generates an independent variable signal representing the value of the independent variable. The sub-function solution corresponding to the value of the independent variable is selected by accessing the look-up table and the processor processes the selected sub-function solution to produce the vapor recovery control signal used to control the vapor pumping arrangement and the vapor recovery rate.

The vapor recovery pumping arrangement may include a vapor pump and an adjustable valve arranged to modulate the amount of vapor pumped through the vapor return line. In one embodiment, the valve is in the vapor return line.

The invention further provides a fuel delivery and vapor recovery system including a fuel delivery line for dispensing fuel, a fuel pump for pumping fuel through the fuel line to a fuel nozzle, a vapor return line from the nozzle including a vapor recovery pumping arrangement for pumping vapor released at the juncture of the fuel nozzle and the receiving tank as fuel is being pumped, and a processor connected to the vapor recovery pumping arrangement. The rate of vapor recovery is adjusted in response to vapor recovery control signals sent from the processor to the vapor pumping arrangement and adjusted to compensate for temperature effects due to differences between the temperature of the liquid fuel being delivered and vapor being recovered. Transducers provide signals representative of the temperatures of the liquid fuel and vapor, and a memory device stores the temperatures of the liquid fuel and vapor until the next fueling operation. The processor may access stored vapor and fuel temperature values for controlling the vapor recovery pumping arrangement without needing to access real-time temperature values.

In a preferred embodiment the memory device reads a first-of-day value from the transducers upon start-up each day and the processor uses that value for computing the vapor recovery control signals for a first filling operation. Typically, the memory device reads an updated value from one of the transducers upon completion of a filling operation and the processor uses the updated value for computing the vapor recovery control signals for a next subsequent filling operation. The apparatus may include a timer, with the memory device reading a second updated value from one of the transducers a period of time alter reading the updated value and the processor using the second updated value for computing the vapor recovery control signals for a next subsequent filling operation. The memory device may be a part of the processor.

The invention also provides a method of dispensing liquid fuel from a tank of fuel to a filler pipe of another tank with recovery of fuel vapor from proximate the filler pipe including providing signals representative of the temperatures of the liquid fuel and vapor, storing the signals representative of the temperatures of the liquid fuel and vapor until the next fueling operation, dispensing the fuel through a fuel delivery line to a fuel nozzle, drawing vapor from the nozzle through a vapor return line from the nozzle at a controlled rate, and adjusting the controlled rate of vapor recovery to compensate for temperature effects due to differences between the temperature of the liquid fuel being delivered and vapor being recovered according to the stored values without needing to access real-time temperature values.

The storing step may include storing first-of-day values of the signals each day for use in a first filling operation.

Typically, the storing step includes storing updated values of the signals after a filling operation for use in a next subsequent filling operation. In one embodiment, the method includes timing the elapsed time after a filling operation and reading a second updated value a period of time alter reading the first updated value and using the second updated value for the next subsequent filling operation.

Furthermore, the invention provides a vapor recovery fuel dispenser including a liquid fuel line extending from a liquid fuel source to a liquid fuel outlet and including a meter that generates a pulse stream at a rate corresponding to a rate of flow of fuel through said line, a vapor recovery line extending from the liquid fuel outlet to a vapor reservoir, a vapor impeller in the vapor recovery line to impel vapor to move from the liquid fuel outlet to the vapor reservoir, and a control for the impeller connected to receive the pulse stream. The control includes a pulse source that generates pulses at a rate faster than an expected pulse rate from the meter and a counter to count the number of pulses from the pulse source during an interval between pulses from the meter. The control derives the control signal for the impeller from the counted number of pulses.

In one embodiment, the vapor impeller is a variable speed positive displacement pump driven by a motor. In another embodiment the vapor impeller is a constant speed pump and a variable position valve controlled by the control.

The invention includes a method of recovering vapor in a fuel dispenser including pumping liquid fuel along a line extending from a liquid fuel source to a liquid fuel outlet, generating a pulse stream at a rate corresponding to the rate of flow of fuel through the line, withdrawing vapor along a vapor recovery line extending from the liquid fuel outlet to a vapor reservoir, pumping vapor in the vapor recovery line from the liquid fuel outlet to the vapor reservoir at a volumetric rate determined by generating pulses at a rate faster than an expected pulse rate from the meter, counting the number of pulses from the pulse source during an interval between pulses from the meter and deriving a control signal for the impeller from the counted number of pulses.

The withdrawing step may include driving a variable speed positive displacement pump by a motor. The withdrawing step may include driving a constant speed pump and varying a valve in accordance with the control signal.

DETAILED DESCRIPTION OF THE PREFERRED EMBODIMENT

The present invention relates generally to a method and system for controlling the rate at which fuel vapor is recovered in a fuel delivery system. Vapor recovery systems used to recover fuel vapors that are released as fuel is pumped from a fuel nozzle are known in the prior art. For an example of a fuel vapor recovery system, one is referred to the disclosure found in U.S. Pat. No. 5,040,577 to Pope and U.S. Pat. No. 5,156,199 to Hartsell et al. Improvements on the Pope apparatus are shown in co-pending U.S. patent application Ser. No. 07/946,741 filed Sep. 16, 1992 and U.S. Pat. No. 5,269,353 issued Dec. 14, 1993. Other patents showing assist-type vapor recovery systems in which the invention may be used are U.S. Pat. No. 5,038,838 to Bergamini et al., U.S. Pat. No. 5,195,564 to Spalding, and German Gebrauchsmuster G87-17378.6. The disclosures of these patent applications, patents and patent publications are expressly incorporated herein by reference.

The present invention is directed to an improved vapor recovery system that has the capability of effectively and efficiently controlling the rate at which vapor released during a fueling operation is recovered. In describing the system of the present invention, it should be appreciated that the structures of fuel vapor recovery systems are well known in the art, and therefore a detailed description of such is not needed to provide those of ordinary skill in the art with knowledge of how to make and use this invention.

Figure 1:
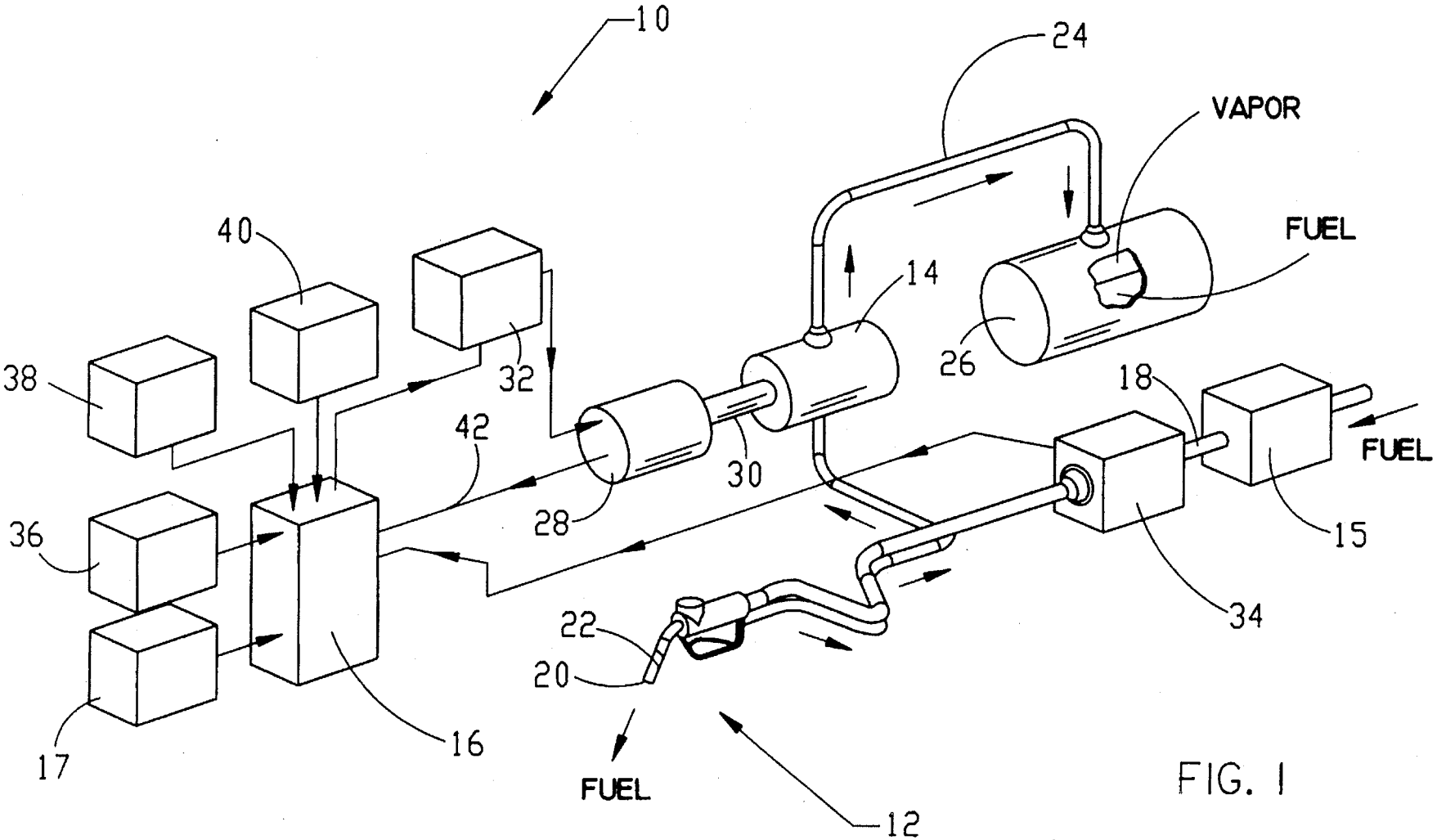
FIG. 1 is a schematic illustration of a preferred embodiment of the vapor recovery system of the present invention.

With further reference to FIG. 1 of the drawings, the preferred embodiment of the vapor recovery system is shown therein and indicated generally by the numeral 10.

As shown in FIG. 1, vapor recovery nozzle 12 directs fuel pumped by fuel pump 15 through fuel delivery line 18 to a spout 20. The spout 20 is typically inserted into the filler neck of a receiving tank to pump the fuel into the receiving tank (not shown). Nozzle 12 also includes a vapor inlet 22, which is communicatively connected to a vapor recovery line 24 that extends from nozzle 12 to a reservoir or tank 26. Tank 26 is typically, but not necessarily, the ullage of the liquid fuel tank.

Connected in the vapor recovery line 24 is vapor pump 14. Vapor pump 14 is a positive displacement pump driven by an electric motor 28 that is connected to the vapor pump 14 by pump shaft 30. Electric motor 28 is controllable to vary the speed (i.e., rotations per minute) that the pump shaft 30 is driven. Therefore, the rate at which vapor pump 14 pumps released vapor into the vapor recovery system 10 is determined by the speed of the pump shaft 30.

Electric motor 28 rotates the pump shaft 30 at a selected speed in response to pump control signals generated by digital processor 16. The pump control signals generated by digital processor 16 are outputted to a motor drive electronics unit 32 that is connected between the processor 16 and electric motor 28. Motor drive electronics unit 32 converts the pump control signals from processor 16 to control the voltage supplied to the electric motor 28. The speed at which electric motor 28 rotates pump shaft 30, and, therefore, the rate at which vapor is recovered is controlled by the voltage supplied to the electric motor 28. In order to maximize the efficiency of vapor recovery system 10, processor 16 must operate vapor pump 14 to recover vapor at a rate that corresponds to the instantaneous vapor volume generated during a fueling operation.

Processor 16 determines the optimal speed of vapor pump 14 by solving a vapor pump control function. A memory 17 is associated with the processor 16. The physical relationship of the look-up memory 17 and processor 16 can be any suitable arrangement of microprocessors and random access or read only or read-write memory devices. These are well-known in digital processing and need no elaboration here. The solution to the control function represents the optimal speed at which vapor pump shaft 30 and vapor pump 14 should be operated. If desired, the function may also account for motor speed feedback signals supplied on line 42. The control function is a function of dependent sub-functions that are, in turn, dependent on one or more independent variables which affect the volume of vapor generated during a fueling operation. The independent variables include fuel flow rate, fuel volume dispensed, time, ambient temperature, fuel temperature, and restrictions in the vapor flow path. The dependent sub-functions of the control function can be modified to take into account additional independent variables.

To determine at what speed vapor pump 14 should be operated, the values of the independent variables must be measured and corresponding independent variable signals inputted into processor 16. A plurality of sensors or transducers are connected to processor 16 and are used to measure independent variables that affect the V/L ratio. In the preferred embodiment, the transducers include a fuel flow transducer 34 (typically a pulser, well-known in the gasoline dispensing art), an ambient temperature transducer 36, a fuel temperature transducer 38, and a vapor path restriction transducer 40. Transducers 34–40 each generate an independent variable signal which represents the value of the independent variable. Other sources of signals representing independent variables affecting the V/L ratio may also be used.

The independent variable signal is directed to and inputted into processor 16. The fuel flow transducer 34 measures the rate of fuel flow to nozzle 12 and directs a fuel flow signal to the processor 16. The ambient temperature transducer 36 measures the ambient temperature which is representative of the temperature of the vapor being recovered, and directs an ambient temperature signal to the processor 16. The fuel temperature transducer 38 measures the temperature of the fuel being directed to nozzle 12 and directs a fuel temperature signal to the processor 16. The vapor path restriction transducer 40 measures the restriction in vapor recovery line 24 and directs a restriction signal to the processor 16.

The values of the independent variables are used to calculate the control function to determine the optimal speed of vapor pump 14. The control function is repeatedly solved and the optimal pump shaft velocity correspondingly adjusted as the independent variables vary during a fueling operation. In order for the control signals to accurately represent the required pump shaft velocity, there must be minimal time delay between the input of the values for the independent variables to processor 16 and the output of the corresponding control signal. Accordingly, the solution of the control function must be processed rapidly.

Vapor recovery system 10 provides for an efficient manner for solving the control function by providing a look-up table. The look-up table contains pre-derived or pre-computed solutions to the dependent sub-functions of the control function. The dependent values contained in the look-up table are indexed by a selected range of values for each of the independent variables. The dependent values are stored in a single or multi-dimensional table depending on the number of independent variables on which the control function depends.

The look-up table is indexed by a selected range of values for each independent variable to allow dependent solutions to the dependent sub-function to be obtained via the look-up table. The range of values for each independent variable is selected to cover a range of values that are likely to occur and be measured during a fueling operation.

In the preferred embodiment of the present invention, a single look-up table and its dependent values are stored in a non-volatile memory. The dependent values of the look-up table are pre-computed once for the selected ranges of values for the independent variables, and the processor 16 uses the same look-up table for each successive fueling operation The values for the independent variables are selected to cover the normal operating conditions for the vapor recovery system 10. If a wide range of measured values for the independent variables can be expected during the fueling operations, then a relatively large look-up table will be required to contain all the dependent values. The size of the memory required and the amount of time required for processor 16 to access a dependent value in the look-up table must be increased as the number of potential dependent values stored in the look-up table is increased. The use of a single look-up table stored in memory is best suited where the range of independent values do not vary widely during fueling operations.

In an alternative embodiment of the present invention, the look-up table is stored in a memory that can be changed, and the look-up tables are periodically updated, such as between fueling operations. The ability to generate updated look-up tables is useful where the range of values of the independent variables may vary widely for different fueling operations. This can permit smaller tables to be used. For example, for an independent variable such as ambient temperature, a permanent look-up table of expected values may have to range over one hundred or more degrees Fahrenheit. If the table need only be used for an hour or less, a ten degree range may be large enough. To create the new look-up table, a new range of dependent values for one or more of the independent variables is selected and the dependent values corresponding to the new ranges of independent variables are computed and stored in the table. Once the new table has been created, the new look-up table replaces the former look-up table and is used for the next fueling operation.

Processor 16 is programmed to generate an updated look-up table in anticipation of a change in the range of expected independent values to be encountered in a fueling operation. When signalled to create a new look-up table, processor 16 begins to compute dependent solutions for the selected ranges of values for the independent variables. The former, completed look-up table is maintained in memory while the new look-up table is being created. If a new fueling operation begins during the creation of the new look-up table, the partially-created, new look-up table is stored in memory and the completed, former look-up table in existence is used for the fueling operation. Creation of the new look-up table is continued between other successive fueling operations until the new look-up table is completed and can replace the older look-up table. Scheduling the creation of a new look-up table between fueling operations limits the processing demands placed on processor 16. The processor may be programmed to begin a new table immediately upon completion of a table or to wait any desired period before beginning a new table.

Use of a look-up table allows processor 16 to more efficiently solve the control function. To rapidly solve the control function, processor 16 uses the look-up table to locate the dependent value of the dependent sub-function associated with the inputted independent values. Relatively simple processing of the located dependent value is then performed to arrive at the solution to the control function. The additional processing is relatively minor and does not place substantial time demands on the processor 16. In this regard, it is preferred to select the subfunctions for the look-up tables so that the resultant dependent subfunction values need only minor, quick computation to compute the control function.

The solution to the control function is used to generate the control signal for controlling the pump shaft velocity. To provide for more exact control of the pump shaft velocity, electric motor 28 is connected to digital processor 16 by a tachometer feedback line 42. Tachometer feedback line 42 is used to send tachometer feedback signals from electric motor 28 to processor 16 as disclosed in Payne, co-pending application Ser. No. 946,741, filed Sep. 16, 1992, entitled "Vapor Recovery Improvements", the disclosure of which is hereby incorporated by reference. The tachometer feedback signals are used by processor 16 to generate the vapor pump control signals so as to more precisely control the speed of vapor pump 14.

As discussed previously, the control function used to generate the vapor pump control signals includes a dependent sub-function that is dependent on several independent variables known in the art. The precise function will be a characteristic of features of the vapor recovery nozzle return line, pump and other components, so specific functions will not be discussed herein.

For explanation purposes, the operation of a vapor recovery system 10 including a control function having a sub-function dependent on two independent variables—ambient temperature and dispensed volume—will be described. A vapor recovery system including a control function dependent on additional independent variables would operate in a manner analogous to the operation described below.

In operation, a control function for determining optimal pump shalt velocity is stored in a memory 17 operatively associated with processor 16. The control function is the ratio of a dependent sub-function dependent on a plurality of independent variables and a computational factor which is proportional to the reciprocal of fuel flow rate. The control function may be expressed as:

$$\frac{V\ \text{rotations}}{\text{minute}} = \frac{S(x_1, \ldots, x_n)}{N\ \text{counts/volume}}$$

where S is a dependent sub-function; $x_1, \ldots, x_n$ represent independent variables;

and N is a computational factor proportional to the reciprocal of fuel flow rate.

For explanation purposes, it will be assumed that the dependent sub-function only includes two independent variables, x,—ambient temperature and fuel volume. As discussed previously, the dependent sub-function could depend on other independent variables.

Figure 2:
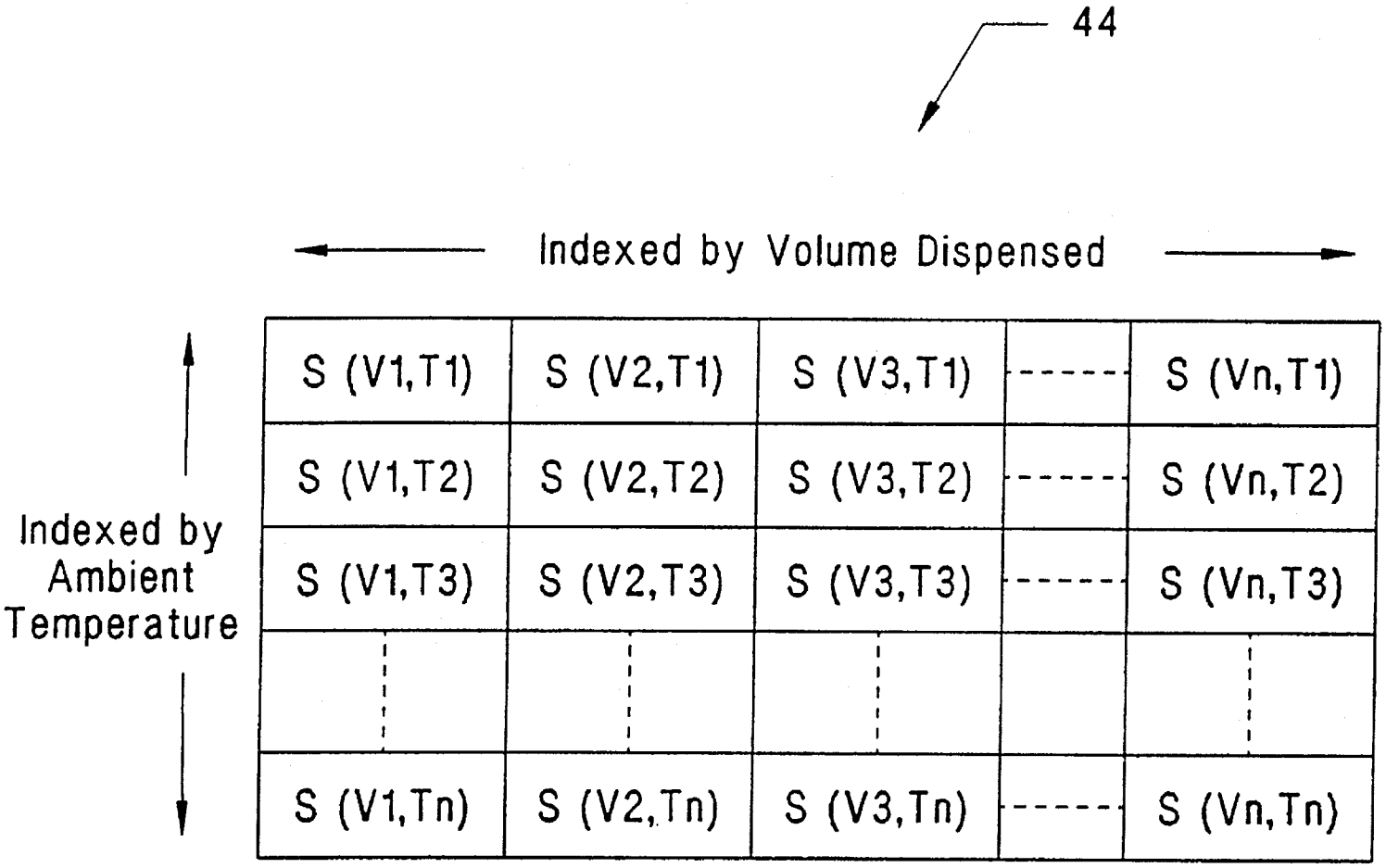
FIG. 2 is a schematic illustration of a look-up table of the preferred embodiment of the vapor recovery system.

Also stored in the memory 17 operatively associated with processor 16 is a look-up table 44, as shown schematically in FIG. 2. The look-up table 44 contains pre-computed dependent values for the range of ambient temperature values ($T_1, \ldots, T_2$) and the range of fuel volume dispensed values ($V_1, \ldots, V_2$). The temperature-dependent function may be as described in U.S. Pat. No. 5,156,199 to Hartsell et al. or as described in U.S. Pat. No. 5,038,838 to Bergamini et al., or any other desired function. Alternatively, the ambient and fuel temperatures may be indices to a look up table, with the desired vapor-to-liquid ratio as the output. This can be accessed using the temperature readings as data inputs to give the V/L ratio.

The volume dispensed-dependent function is preferably as described in copending application Ser. No. 968,595 filed Oct. 29, 1992. The dependent values are indexed by corresponding ambient temperature values and fuel volume dispensed values.

A fueling operation begins when a user begins dispensing fuel from nozzle 12. As the fueling operation begins, vapor recovery system 10 monitors the ambient temperature and the amount of fuel volume dispensed. Ambient temperature is measured directly by ambient temperature transducer 36 and an ambient temperature signal is inputted into processor 16.

Fuel volume is determined by measuring fluid flow with fuel flow transducer 34. As fuel is dispensed, a fuel pulse is generated for a precise volume of fuel dispensed and is directed to processor 16. Processor 16 accumulates the pulse count and, based on the fuel pulse count and fuel volume per fuel pulse, processor 16 determines the fuel volume dispensed.

Processor 16 uses the measured values liar ambient temperature and fuel volume dispensed to obtain the solution to the dependent sub-function which is associated with the measured ambient temperature value and fuel volume dispensed value. According to an embodiment, the look-up table may be as shown in FIG. 2, a two-dimensional table in which the solution, S, as a function of the T and V data can readily be read. Because the dependent values are indexed by the ambient temperature values and fuel volume dispensed values, the solution to the dependent sub-functions for the measured values can be efficiently located by processor 16 in the look-up table 44. Those values then can be used simply by the processor 16 to determine the subfunction S. Alternatively, if desired, two one-dimensional tables could be used, giving output values requiring only simple further processing to arrive at S.

To solve the control function, processing of the obtained dependent value for the dependent sub-function must be performed by processor 16. In particular, the dependent value obtained is divided by the parameter N, proportional to the reciprocal of fuel flow rate.

The parameter N is determined by allowing a counter in processor 16 to increment at a fixed rate, which is higher than the expected liquid flow pulse rate between two successive flow rate pulses $P_1$ and $P_2$. If the counter is reset upon detection of each pulse, the count N, present after the second pulse $P_2$, will be proportional to the reciprocal of the flow rate. As will be appreciated, the counter increments by counting the number of pulses of a pulse source in the processor.

The actual fuel flow rate could be obtained by accumulating pulses over a fixed period of time. However, the reciprocal of fuel flow is more advantageous in that only two pulses from the fuel flow pulser must occur before flow rate is known for any flow rate, whereas an extended duration of time must be allotted for accumulating pulses over time to obtain a sufficiently usable accuracy, especially at low fuel flow rates.

The determination of N and the additional processing of the obtained dependent value places little demand on processor 16. The control function can be computed by dividing S from the look-up table by N, a very quick operation. Accordingly, the determination of the solution for the control function is efficiently determined without excessive real-time processing demands.

Figure 4:
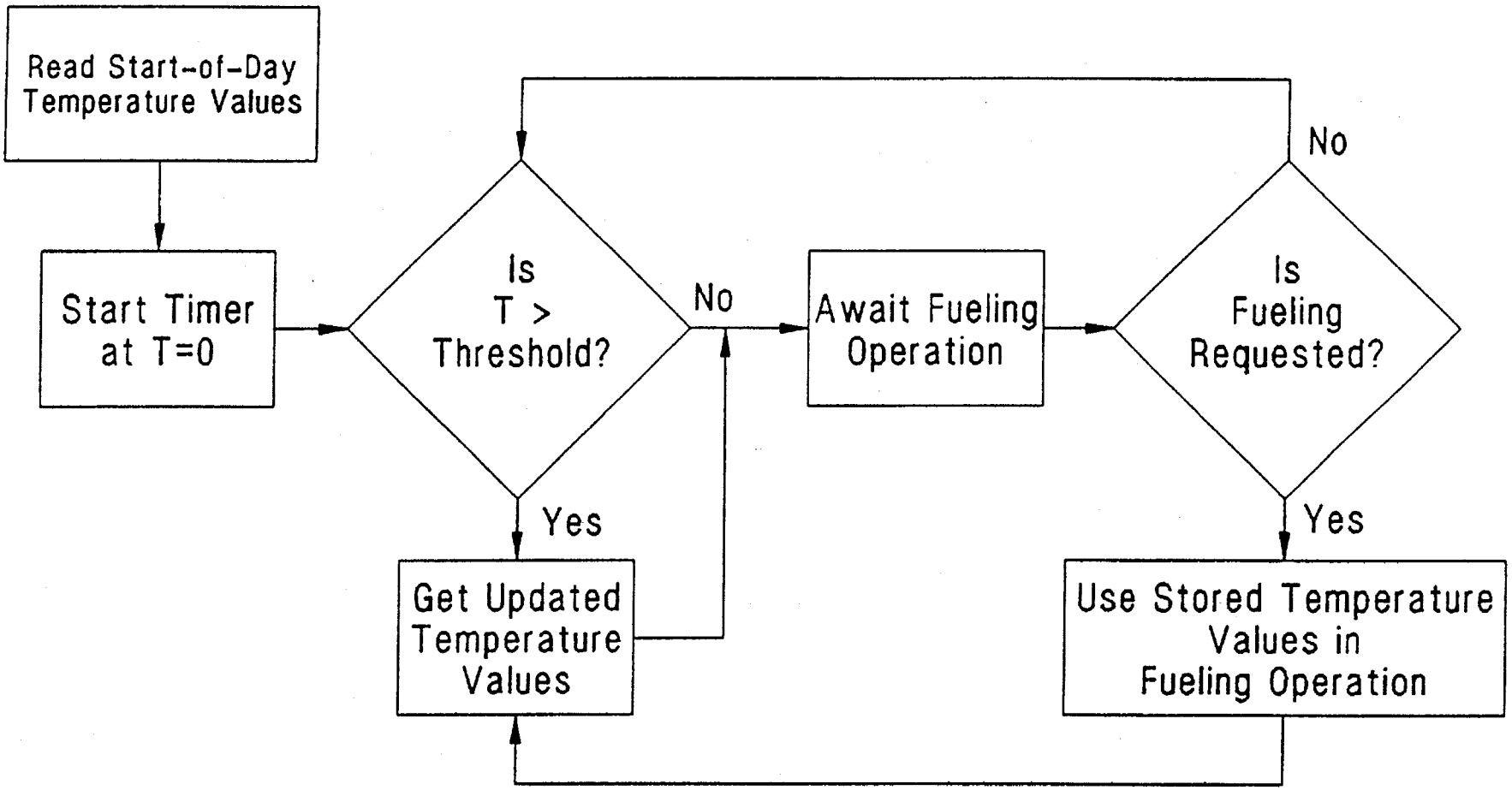
FIG. 4 is a flow chart of an alternate processing procedure used in either of the embodiments of FIGS. 1 or 3.

Processor 16 also continuously receives tachometer signals from vapor pump electric motor 28 for providing precise control of vapor pump speed. The tachometer vapor pump signals are sent over the tachometer feedback line 42 and are used along with the solution to the control function to generate a pump control signal that can compensate for pump motor velocity slewing. Because the ambient temperature and fuel volume dispensed vary during the fueling operation, vapor pump control signals are continuously generated and used to control vapor pump 14 as discussed above. (An alternate embodiment involving an approximation of the temperature in these calculations is described below in connection with FIG. 4.) Controlling the vapor pump 14 in this manner results in the vapor recovery rate of vapor recovery system 10 closely corresponding to the instantaneous rate of fuel vapor released at nozzle 12.

After the user ceases to pump fuel from nozzle 12, the fueling operation ends, and processor 16 is no longer required to monitor the rate of fuel vapor released at nozzle 12. No real-time processing demands are placed on processor 16 between fueling operations. As discussed previously, the processor 16 may be programmed so that an updated look-up table is created between successive fueling operations without placing excessive demands on processor 16.

Figure 3:
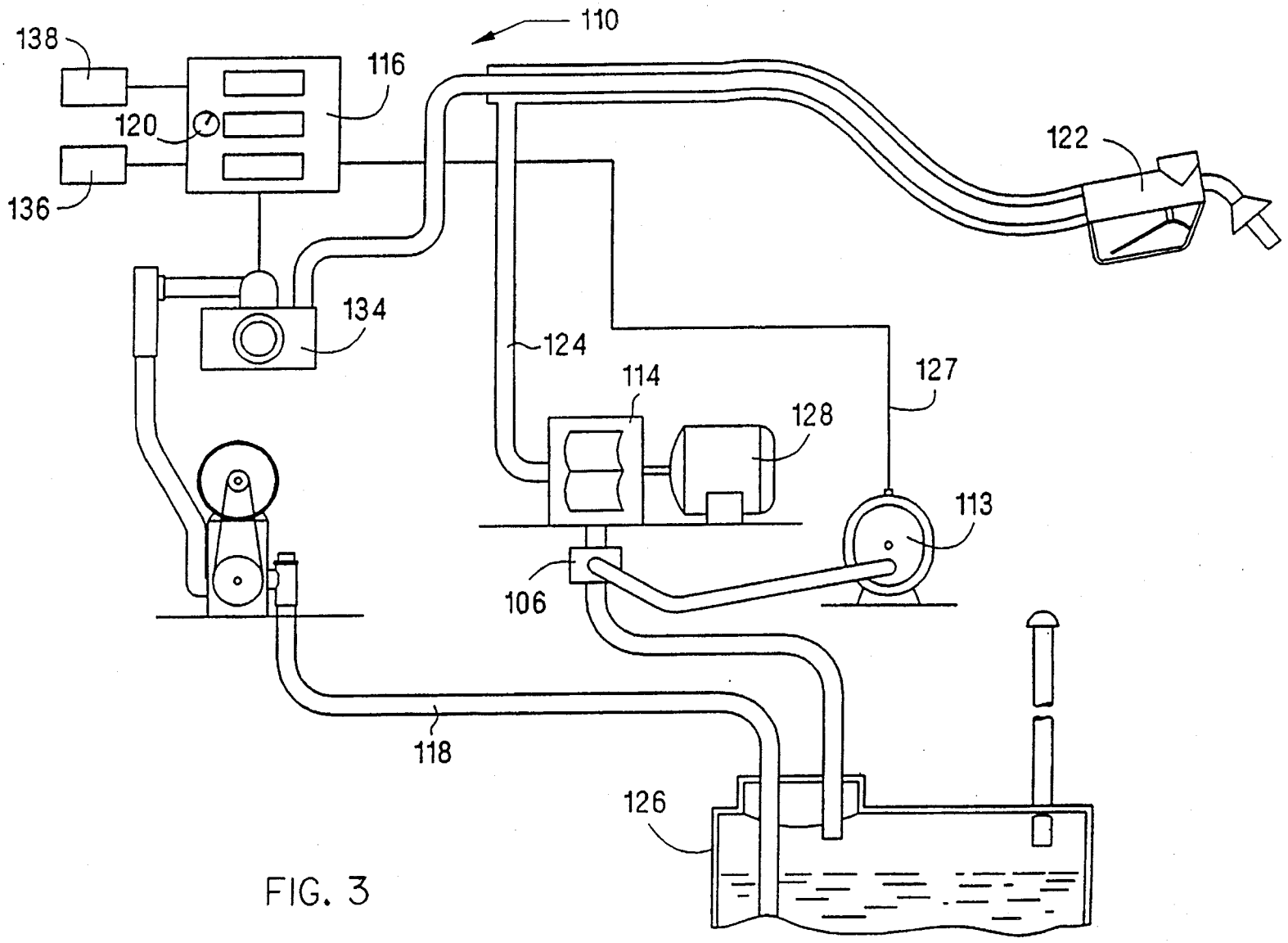
FIG. 3 is a schematic illustration of an alternate embodiment of the invention.

Referring now to FIG. 3, an alternate embodiment of the invention is shown. This drawing figure is an adaptation of FIG. 3 of German Gebrauchsmuster G87-17378.6, the entire disclosure of which is incorporated by reference.

In this embodiment, the liquid gasoline is pumped out of the tank 126 through line 118 and past fluid flow transducer 134, ultimately being dispensed through vapor recovery nozzle 122. The signals concerning the liquid flow rate are generated by the pulser 134 and communicated to a microprocessor in computer 116. Vapor recovered at the nozzle 122 is communicated along vapor recovery line 124 under the influence of vapor pump 114, driven by motor 128. Motor 128 differs from motor 28 in being a constant speed motor, so that pump 114 operates at a generally constant volumetric output rate or constant rotational speed. The output of the pump 114 passes through a vapor valve 106 before being returned to the ullage of tank 126. The valve 106 is controlled by a motor 113 to vary the restriction in the vapor line 124. The valve 106 may be a proportional valve. This has the effect of modulating the amount of vapor passed by the pump 114. As noted above, the control of the amount of vapor is what is important, whether it be by varying a pump speed as in the embodiment of FIG. 1 or varying the opening of the valve 106 as in the embodiment of FIG. 3. Thus, the microprocessor 116 is provided with transducer inputs 136, 138, analogous to the transducer inputs 36 and 38 of the embodiment of FIG. 1, along with liquid flow rate data from the pulser 134. The microprocessor 116 may use the transducer data to look up subfunction values in a look-up table associated with the microprocessor 116 to compute the valve control function for output on line 127. The type of signal output of line 127 can be selected in accordance with the design of the motor 113 to achieve the desired ends. In one embodiment, the motor 113 is stepper motor, so that signals on line 127 can be pulse signals to stepper motor 113 to open or close the valve 106.

While the embodiment of FIG. 3 is much less preferred than the embodiment of FIG. 1 because it is believed that the embodiment of FIG. 1 gives much more precise control over the actual vapor flow rate, the invention is properly deemed to encompass implementation of this technique to the apparatus in FIG. 3.

If desired, the demands on the processor 116 can be reduced even further by not using real time values of the liquid and ambient temperatures from the transducers 136, 138. Instead, recent values can be stored as a fixed constant under the assumption that the rate of change of temperature will be slow enough that treating the temperatures as constants will not introduce much error.

In this alternative embodiment, the microprocessor 116 takes a reading from the transducers 136, 138 at the beginning of the day upon start-up of the equipment. This data can be stored as raw data or used to re-compute a look-up table as described above. The degree of sophistication of the electronics will be dictated by the degree of sophistication of the control function being used. For example, if the control function uses a simple ratio of the absolute value of the temperature of the vapor to the absolute value of the temperature of the liquid, the ratio can be computed and stored itself. Alternatively, if more complex functions like those shown at column 2, line 6, of U.S. Pat. No. 5,156,199 of the Hartsell, Jr. et al. patent or the equations shown in U.S. Pat. No. 5,038,838 to Bergamini et al. are used, then more extensive calculations for storing the constant temperature values in look-up table will be desired.

It will be appreciated that the control function to be used may very well be quite specifically designed for the equipment and its geometry, and the present invention is deemed to cover all such control functions and their pre-computed or pre-stored microprocessor-usable subfunction values.

Also as can be seen in FIG. 3, the microprocessor 116 includes a timer 120. If the time between fuelings become excessively long, the pre-stored data from the transducers 136, 138 may become inaccurate thus, upon an expiration of a time measured by the timer 120, fresh values can be obtained and stored as described above. An implementation of this procedure is shown in the flow chart of FIG. 4.

The present invention may, of course, be carried out in specific ways other than those herein set forth without departing from the spirit and essential characteristics of the invention. For example, in an embodiment like the one shown in FIG. 1, if a vapor pump other than a positive displacement pump is used, the computed control function may be adapted to control the vapor pumping rate according to the characteristics of the chosen vapor pump, instead of focussing on the rotational speed of the driving motor.

The present embodiment are, therefore, to be considered in all respects as illustrative and not restrictive and all changes coming within the meaning and equivalency range of the appended claims the intended to be embraced therein.

What Is claimed is:

1. A vapor recovery fuel dispenser comprising a liquid fuel line extending from a liquid fuel source to a liquid fuel outlet and including a meter that generates a pulse stream at a rate corresponding to a rate of flow of fuel through said line, a vapor recovery line extending from said liquid fuel outlet to a vapor reservoir, a vapor impeller in said vapor recovery line to impel vapor to move from said liquid fuel outlet to said vapor reservoir, and a control for said impeller connected to receive said pulse stream, said control including a pulse source that generates pulses at a rate faster than an expected pulse rate from said meter and a counter to count the number of pulses from said pulse source during an interval between pulses from said meter, said control deriving a control signal for said impeller from the counted number of pulses.

2. A vapor recovery fuel dispenser as claimed in claim 1 wherein said vapor impeller is a variable speed positive displacement pump driven by a motor.

3. A vapor recovery fuel dispenser as claimed in claim 1 wherein said vapor impeller is a constant speed pump and a variable position valve controlled by said control.

4. A method of recovering vapor in a fuel dispenser comprising pumping liquid fuel along a line extending from a liquid fuel source to a liquid fuel outlet and generating a first pulse stream at a rate corresponding to the rate of flow of fuel through the line, withdrawing vapor along a vapor recovery line extending from the liquid fuel outlet to a vapor reservoir, pumping vapor in the vapor recovery line from said liquid fuel outlet to said vapor reservoir at a volumetric rate determined by, generating second pulses at a rate faster than an expected pulse rate in the first pulse stream, counting the number of second pulses generated during an interval between pulses in the first pulse stream and deriving a control signal for said vapor pumping step from the counted number of second pulses.

5. A vapor recovery method as claimed in claim 4 wherein said withdrawing step includes driving a variable speed positive displacement pump by a motor.

6. A vapor recovery method as claimed in claim 4 wherein said withdrawing step includes driving a constant speed pump and varying a valve in accordance with the control signal.

* * * * *